US006521120B1

(12) United States Patent
Grimwood

(10) Patent No.: US 6,521,120 B1
(45) Date of Patent: Feb. 18, 2003

(54) CONTINUOUS CENTRIFUGES

(75) Inventor: Geoffrey Clive Grimwood, Holmfirth (GB)

(73) Assignee: Thomas Broadbent & Sons Ltd. (GB)

( * ) Notice: Subject to any disclaimer, the term of this patent is extended or adjusted under 35 U.S.C. 154(b) by 0 days.

(21) Appl. No.: 09/641,059

(22) Filed: Aug. 17, 2000

(30) Foreign Application Priority Data

Aug. 19, 1999 (GB) ..... 9919555

(51) Int. Cl.[7] ..... B04B 3/00; B04B 11/02; C13F 1/06

(52) U.S. Cl. ..... 210/103; 210/369; 210/377; 210/380.1; 210/391; 494/36; 127/19

(58) Field of Search ..... 210/103, 391, 210/360.1, 369, 377, 380.1; 127/19; 494/36

(56) References Cited

U.S. PATENT DOCUMENTS

| | | | | |
|---|---|---|---|---|
| 1,569,778 | A | 1/1926 | Murphy | |
| 2,328,394 | A | 8/1943 | Neuman | |
| 3,799,353 | A | 3/1974 | Pause | |
| 3,805,956 | A | 4/1974 | Mercier | |
| 3,844,949 | A | 10/1974 | Mercier | |
| 4,008,098 | A | 2/1977 | Dietzel et al. | |
| 4,762,570 | A | 8/1988 | Schaper | |
| 6,267,899 | B1 * | 7/2001 | Greig et al. | 210/781 |

FOREIGN PATENT DOCUMENTS

| | | |
|---|---|---|
| DE | 23 64 260 | 6/1975 |
| DE | 26 49 037 | 6/1977 |
| FR | 1355763 | 2/1964 |
| GB | 918386 | 2/1963 |
| WO | WO 95/21697 | 8/1995 |

OTHER PUBLICATIONS

PTO 02–2753; Translation of FR 1,355,763; Feb. 1964.*
PTO 02–2754; Translation of DE 26 49 037; Jun. 1976.*
PTO 02–31218; Translation of DE 23 64 260; Jun. 1975.*
European Search Report, Dec. 14, 2001, Applicant: Thomas Broadbent & Sons Limited, Application No. EP 00 30 7037.

* cited by examiner

*Primary Examiner*—David A. Reifsnyder
(74) *Attorney, Agent, or Firm*—Brooks & Kushman P.C.

(57) ABSTRACT

A continuous centrifuge of the type comprising a perforated basket of generally frusto-conical configuration which is adapted to rotate about a rotational axis and along whose inner peripheral wall a liquids/solids mix is caused to travel, with solids being discharged over the mouth of the rotating basket at its wider end and liquids being collected via the basket perforations. The basket has at least three separating stages of different inclination relative to the basket rotational axis, with the respective residence time over each separating stage being controlled by the basket angle locally to set the angle to suit the local values controlling the flow at that stage.

16 Claims, 4 Drawing Sheets

CONTINUOUS CENTRIFUGES

The present invention relates to continuous centrifuges of the type comprising a rotating perforated drum or basket (hereinafter referred to as a "basket"), along whose inner peripheral wall a liquids/solids mix is caused to travel, with solids being discharged over the mouth of the rotating basket and liquids being collected via the basket perforations.

The separation of crystalline materials from liquid (for example, sugar crystals in molasses) may be made in a tapered, rotating and perforated basket. In the present state of the art the basket is conical with the straight sides subtending an angle in the range of 22° to 36° to separate sugar crystals—with angles larger or smaller used on some other products. The conical basket is usually of single angle throughout its length, although it is also known for the basket to have regions of two different basket angles. For example, U.S. Pat. No. 379,953 describes a centrifuge basket having two portions of different inclination so selected that they are greater than the greatest angle of slide of the solid phase that is to be separated by the centrifuge. WO95/21697 describes a centrifuge basket having two portions of different inclination corresponding respectively to a lower zone providing drainage and filtration and an upper zone providing drainage only.

FIG. 1 of the accompanying drawings shows a typical state of the art continuous centrifuge. The basket (1) is perforated (2) and lined with a screen (3) perforated with fine slots, the slot width being less than the minimum crystal dimension. The basket rotates about a vertical axis (4) driven by a motor (5) and belts (6). The massecuite (a mixture of crystals and mother liquid) (7) flows through a control valve mounted near the axis (4) into a feeding pot (9). The function of the pot is (a) to accelerate the massecuite to the rotational speed of the smaller diameter (10) of the basket and (b) to distribute the massecuite evenly around the periphery of the basket smaller diameter portion (10). The solids remain suspended in the liquid until deposited on screen (3) for separation to commence. The angle (11) of the basket is such that the massecuite and crystals migrate up the basket wall, the mother liquid flowing progressively through the slots in the screen (3) and basket perforations (2) as it is subjected to the increasing centrifugal force of rotation. The crystals remain on the slotted screen and slide to the largest diameter of the basket to be discharged over the lip (12). The outer casing (13) of the centrifuge and baffles (14) guide the separated liquid and crystals to outlets (15) and (16), respectively.

The efficiency of the separation achieved, usually measured by the proportion of the total liquid separated (a small amount of liquid being carried over by the solids), depends upon the time taken for the crystals to travel over the slotted area of the screen—referred to as the "residence time". The longer the residence time the higher the separating efficiency. FIG. 2 of the accompanying drawings shows, in an elementary way and omitting the effects of gravity, the frictional and rotational forces on a typical isolated crystal on the perforated screen (3).

In FIG. 2, the isolated crystal (17) of unit mass is at radius r in conical basket (1) of angle $\Theta$ and rotation w. The centrifugal force G applied to the crystal is resolved into force x pushing the crystal up the basket and force y normal to the basket wall. The frictional force F between the crystal and basket wall that resists the movement of the crystal is $\mu$. y, where $\mu$ is the coefficient of friction. From the geometry of FIG. 2, for the crystal to move to discharge, x must be greater than $\mu$.y. For an acceptable residence time then, tan $\Theta$ must be slightly greater than $\mu$.

Changes in the characteristics of the solid/liquid mixture as it moves up the screen during separation reduce the efficiency and residence time of the centrifuge described above. As the massecuite flows over the separating zone of the basket it passes through the stages described hereinafter and shown in FIG. 3 of the accompanying drawings. (In this figure the dimensions of the flow are exaggerated to demonstrate the changes as separation proceeds).

Liquid stage (18).

The massecuite 3A is subject to relatively low centrifugal force, much of the liquid remains in the basket and the flow is that of a liquid carrying individual free solids. The flow through this zone is streamlined with increasing viscosity as the liquid content is reduced, the viscosity being the main factor in controlling the flow rate.

Intermediate stage (19).

As the centrifugal force increases, more liquid is separated and some crystals make contact with others, with the interstices between them being filled with liquid. The crystals then slide on the screen (3), lubricated by the outward flow of inter-crystalline liquid. Both liquid viscosity and coefficients of friction between crystals (17) and screen (3) control the flow rate. During this stage, crystals appear on the surface of the liquid.

Solids stage (20).

Under high centrifugal force, the solids approaching discharge will behave either independently or as an interconnected mass. In the former, the solids volume is low and the solids are not in contact with each other. They slide independently to discharge, the sliding rate depending primarily upon the crystal (17) to screen (3) coefficient of friction. In the latter, a higher solids volume causes the crystals to be in contact with each other. Then the sliding rate to discharge will depend also on the inter-crystalline friction and any compaction or deformation of the crystals. This additional intercrystalline friction reduces the velocity of the crystals along the basket wall and increases the crystal residence time.

Wash stage (21).

On some applications, an additional liquid is applied near the junction of stages (19) and (20) and/or (18) and (19) to assist separation. This displaces some of the remaining mother liquid, washes the crystals and alters the viscosity locally.

In practice, there is a smooth transition between stages (18), (19) and (20) and out of the wash stage (21). At the commencement of stage (18), the thickness t of the massecuite can be many times that of the crystal bed of stage (20), altering the apparent angle at the massecuite inner surface to assist flow.

The residence time in each of the stages described above depends upon the viscosity, crystal/liquid ratio, coefficient of friction between the screen and crystals, the interactions between adjacent crystals and centrifugal force. These vary between the stages and the angle of the straight-sided conical basket must be chosen to ensure that the crystals slide under the most difficult conditions in a selected one of the stages, for example stage (20). Residence time is then uncontrolled during the other separating stages resulting in reduced residence time and separating efficiency.

In accordance with a first aspect of the present invention, the residence time over each separating stage individually is controlled by selecting and setting the basket angle locally to suit the local values controlling the flow at that stage. By this means, a desired residence time can be achieved during all separating stages, the basket separating surface can be used fully and maximum separating efficiency achieved.

In accordance with a second aspect of the present invention, there is provided a continuous centrifuge of the type comprising a perforated basket of generally frusto-conical configuration which is adapted to rotate about a rotational axis and along whose inner peripheral wall a liquids/solids mix is caused to travel, with solids being discharged over the mouth of the rotating basket at its wider end and liquids being collected via the basket perforations, wherein the basket wall has at least three regions of different inclination relative to the basket rotational axis corresponding respectively to (i) a liquid stage at the narrow most end of the basket wherein, in use, solids in a liquids/solids mix are largely suspended as individual particles in a liquid volume, with liquid viscosity and local basket angle being principally responsible for controlling the flow rate of the mixture along the inclined basket wall, (ii) an intermediate stage wherein, in use, the solids are immersed in a reduced liquid volume such that contact with each other and with the basket wall is increased, with a resulting increased liquid viscosity, frictional contact between some of the solids and the basket wall, and local basket angle being principally responsible for controlling the flow rate of the mixture along the inclined basket wall, and (iii) a solids stage wherein, in use, surplus liquid having been substantially removed via the basket perforations, solids are largely in contact with each other and the screen, with the coefficient of friction between the solids and the basket wall, between solid particles themselves and local basket angle being principally responsible for controlling the flow rate of separated solids, and wherein the local basket angle of each stage is set to control the flow rate and residence time over each stage individually.

The basket wall can include a washing stage located either between the liquid and intermediate stages and/or between the intermediate and solids stages.

The basket inclination at the washing stage can be different to that at any of the liquid, intermediate and solids stages.

In some embodiments, the different basket stages are joined together with abrupt changes in basket angle. In other embodiments the different drum stages are joined together with smooth changes of angle.

In some embodiments, the angles of the various basket stages are of progressively increasing angle towards the discharge end. In other embodiments, the basket stages can be of progressively decreasing angle towards the discharge end, except perhaps for intermediate washing stages which may be at a reduced or increased basket angle compared to that of the preceding stage.

Advantageously, there is a reduction in the basket angle adjacent the mouth of the basket over which solids are discharged.

Some embodiments can include a colour sensing device disposed so as to be focussed on a position in the basket where a colour change is expected in use of the centrifuge between the intermediate and solids changes, and a first control device which responds to detection of a predetermined colour to adjust the flow of liquids/solids mix into the basket or to adjust the speed of basket rotation whereby to correspondingly adjust a colour change line into a desired position.

Some embodiments can include a viscosity or pressure transducer which is fitted at a position in the basket wall to rotate therewith, and a second control device which detects the level of viscosity or pressure at that position in the basket wall and adjusts the flow of liquids/solids mix to achieve a predetermined value of viscosity or pressure at that position to control the position of the colour change line.

The invention also includes a continuous centrifuge of the type comprising a perforated basket of generally frusto-conical configuration which is adapted to rotate about a rotational axis and along whose inner peripheral wall a liquids/solids mix is caused to travel, with solids being discharged over the mouth of the rotating basket at its wider end and liquids being collected via the basket perforations, characterised in that the basket has at least three separating stages of different inclination relative to the basket rotational axis, with the respective residence time over each separating stage being controlled by adjusting and changing the basket angle locally to set the angle to suit the local values controlling the flow at that stage.

The invention is described further hereinafter, by way of example only, in connection with the separating of sugar crystals from molasses and with reference to the accompanying drawings, in which.

Figure 1:
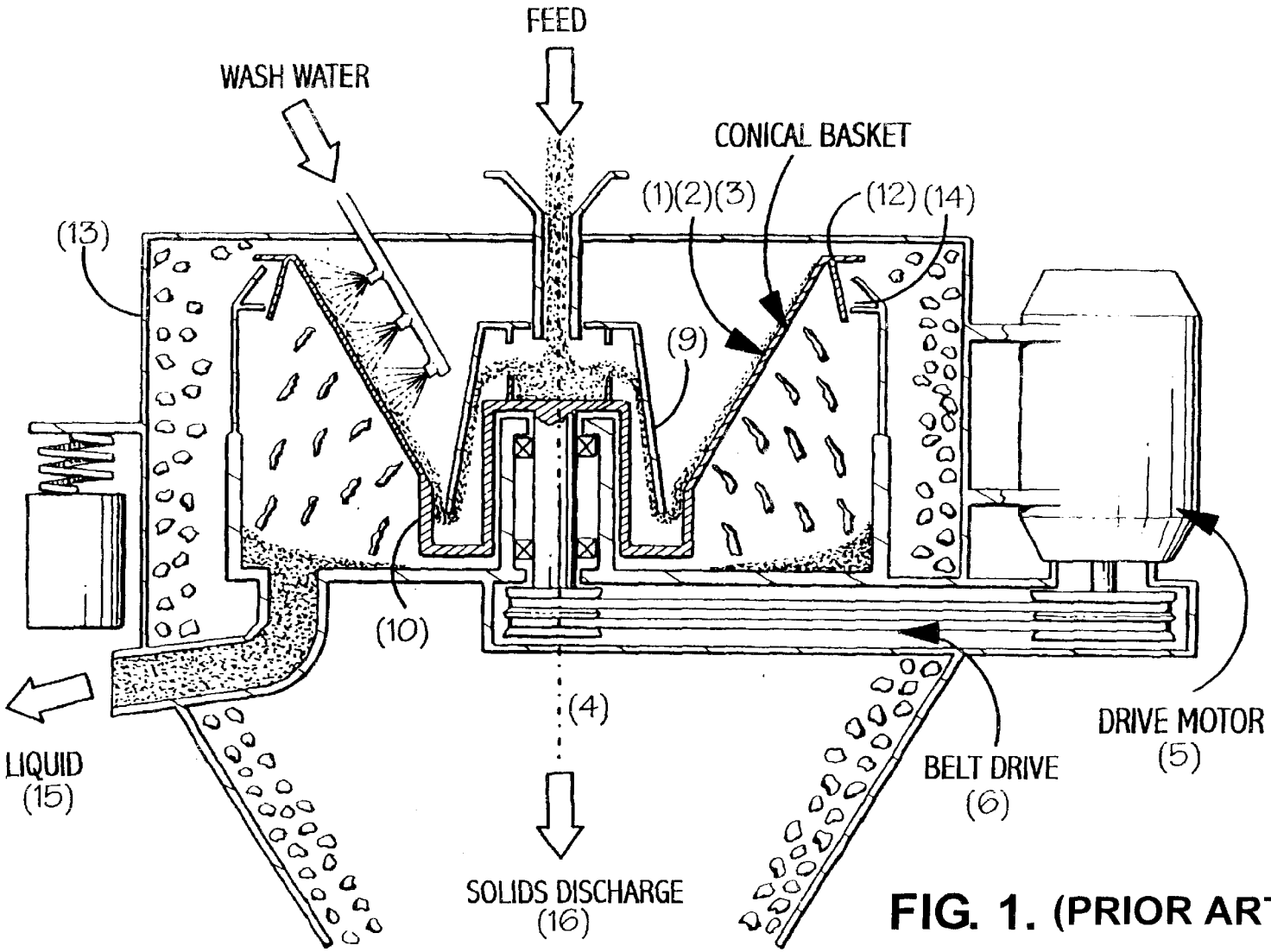
FIG. 1. (PRIOR ART)
FIG. 1 shows a typical state of the art centrifuge to which the present invention is applicable.
Figure 2:
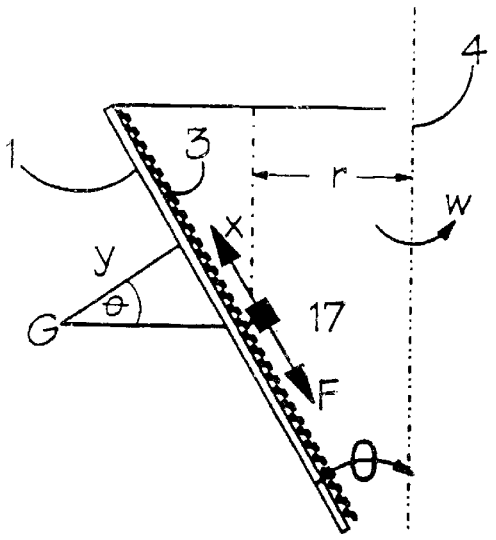
FIG. 2. (PRIOR ART)
FIG. 2 illustrates in an elementary manner and omitting the effects of gravity, the frictional and rotational forces on a typical isolated crystal.
Figure 3:
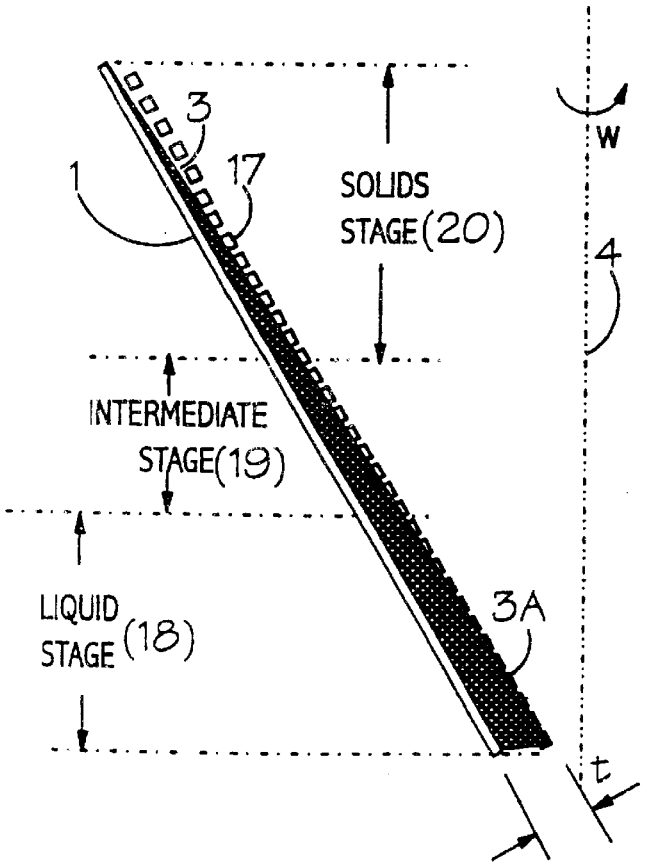
FIG. 3. (PRIOR ART)
FIG. 3 illustrates various stages through which the liquid/solids mixture passes in travelling along the basket.

With increasing viscosity, the flow enters the intermediate stage, the coefficient of friction of the solids (now in contact with the screen and each other but lubricated with a thin film of molasses) increase the resistance to flow, requiring an increase in basket angle—typically in the range of 10° to 25°.

On entering the solids stage, the crystals (now occupying a larger separating area and higher centrifugal force) are pressed firmly against the perforated screen (3) and the intercrystalline friction and/or the coefficient of friction with the screen dictate the sliding or flow rate. A further increase in basket angle, typically in the range of 20°–35°, is now required.

If a crystal wash stage (21) is required at the end of the intermediate stage (19), a fourth change in basket angle may be needed depending upon the wash liquid applied. If this removes the molasses surface from the crystals, an angle between that of the intermediate and solids stages would be needed. In practice, the wash stage may lie in the range of 5°–30°, depending on where it is positioned.

In practice, the factors controlling the flow change gradually within each stage, and from stage to stage. In one preferred arrangement of this invention, the basket shape would be a continuous curve through points (a), (b), (c) and (d) of FIG. 4 as shown in FIG. 5. For completeness and clarity, FIG. 5 contains a wash stage, and is drawn to show clearly the transition to a smooth curve.

For sugar separation, any wash stage is usually applied at or near the end of the intermediate stage, at which point the appearance of the flow changes from dark to light brown as the crystals begin to appear on the surface. The position of this colour change (i.e. the line between the intermediate and solids stages) will move if the massecuite flow rate changes. A further, although not essential, feature of this invention is the introduction of a colour sensing device (illustrated diagrammatically at 30 in FIG. 4) focused on the position where the colour change is required. If the colour sensing device records dark brown, a control system 32 is arranged to reduce the massecuite flow into the basket or to increase the speed of rotation. If light brown is sensed, the control system 32 does the converse, thus maintaining the colour change line in the correct position and matching the stages 18,19,20,21 to the basket profile.

Figure 4:
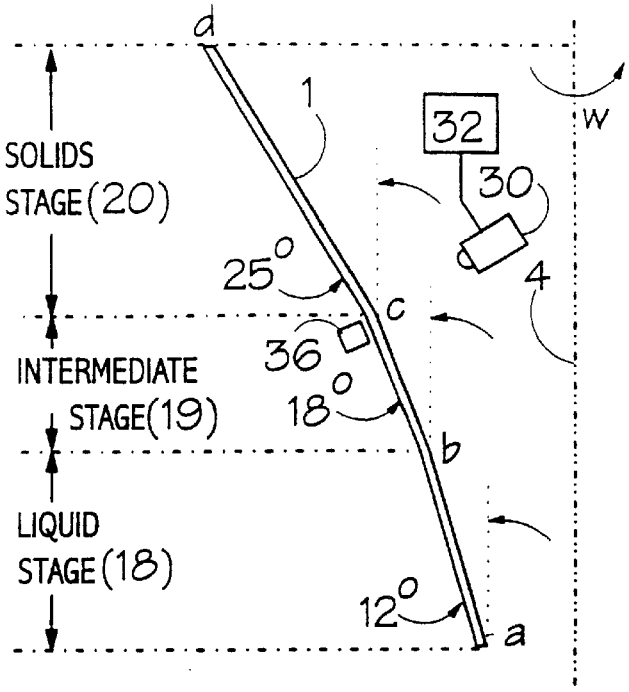
FIG. 4 shows a basket in accordance with the present invention formed from three different short conical sections of progressively increasing angle.
Figure 5:
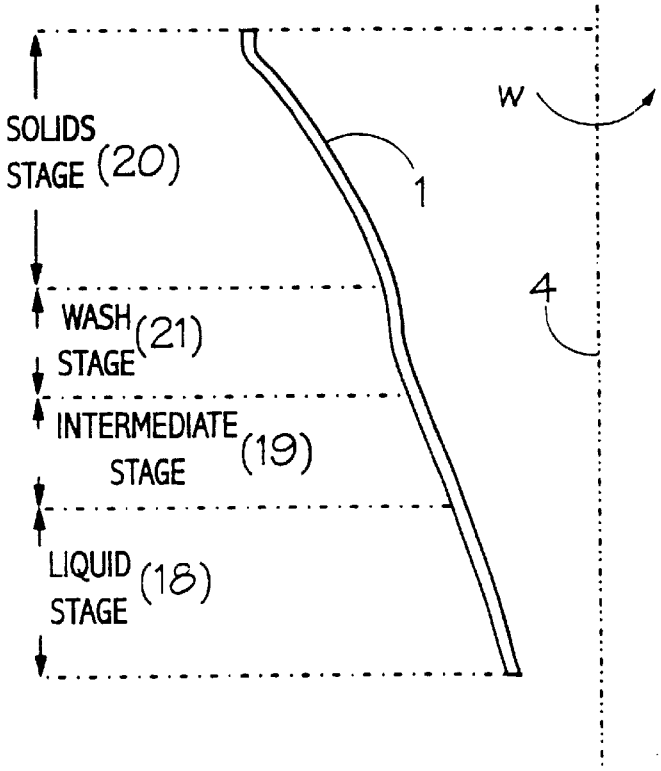
FIG. 5 shows a basket in accordance with the present invention similar to that of FIGS. 4 and 4A but with a wash zone and formed with smooth curves without abrupt changes in angle between sections.

A further alternative, although not an essential feature, is the fitting of rotating viscosity or pressure transducers in the basket, typically positioned near the junction of stages 18 and 19 (or 19 and 20)(for example as shown diagrammatically at 32 in FIG. 4). The transducers are connected via cables and slip rings mounted on axis (4) or via another form of link, to an external control device or unit 36. When the control unit registers high viscosities or pressure, indicating excess liquid, it reduces the massecuite flow (or increases the speed of rotation) and vice versa to match the stages of the basket profile.

Both control schemes would normally adjust the massecuite flow rate, for the required degree of separation, making speed changes, within a set maximum, only if flow limits were reached.

The separation of sugar from molasses is characterised by high molasses viscosity, high solids content in the massecuite and a regular crystalline solid. The invention is applicable to other solids/liquid separations over which the liquid viscosity, solids shape, type, size distribution and coefficient of friction can vary widely.

Figure 6:
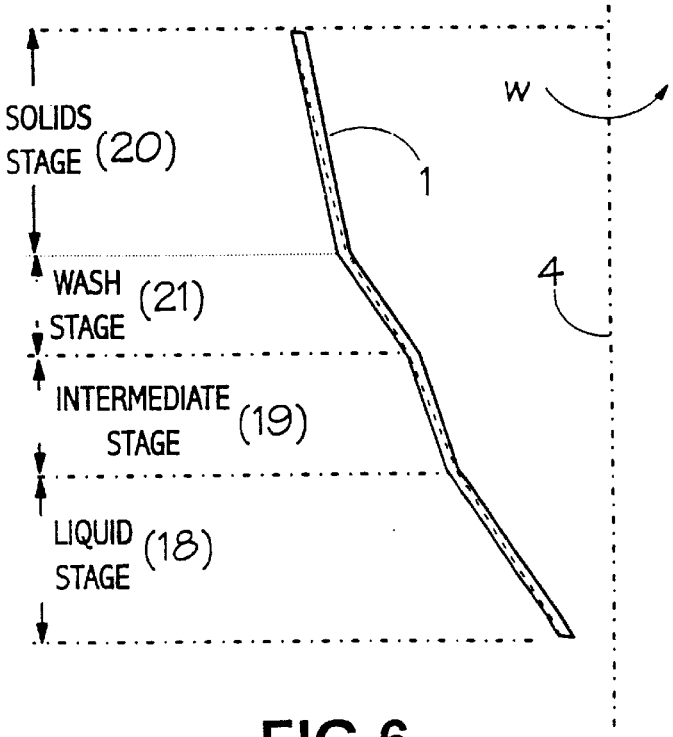
FIG. 6 shows a basket in accordance with the present invention wherein the stages are of progressively reduced angle, except for the wash stage.

Whilst the invention described above, generally in terms of sugar separation, displays a basket of increasing angle towards the crystal discharge (i.e. it is 'trumpet' shaped), for other products, for example a near spherical solid of low coefficient of friction (and prone to roll rather than slide in the solids stage 20) in a high viscosity liquid, a larger liquid stage angle would be followed by progressive reduction in angle through the intermediate and solids stages, producing a 'cup shaped' basket. The addition of a wash stage with a high viscosity wash liquid would then require a wash zone with a locally increased angle to give the basket shape shown on FIG. 6—where the full line shows the basket built up from conoidal sections and the dashed line the basket of smooth curves and corresponding to FIG. 5.

Baskets used in this invention may be manufactured in metal, reinforced resin or other materials. The preferred material for baskets built from a series of conoidal sections of varying angles is steel. The preferred material for baskets with curved sides is fibre reinforced resin following the process outlined in UK Patent Application No. 9121174.8.

Figure 4A:
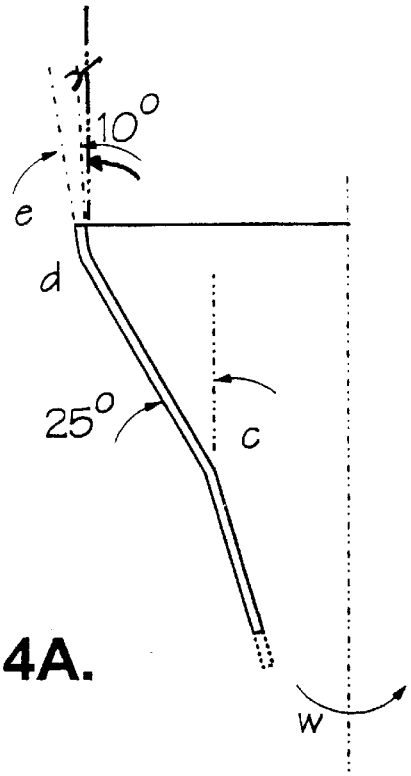
FIG. 4A is a partial reproduction of FIG. 4 which shows the reduction in basket angle at the discharge lip to take advantage of the intercrystalline friction.

In FIG. 4A, there is depicted a reduction of basket angle/inclination near the discharge lip (section d–e). The section d–e is short (less than 5–10% of the basket height). It is inclined at an angle of about 10° to the basket axis, so that a small volume of solids is retained on the basket wall to increase the residence time locally.

What is claimed is:

1. A continuous centrifuge comprising a perforated basket of generally frusto-conical configuration which is adapted to rotate about a rotational axis and along whose inner peripheral wall a liquids/solids mix is caused to travel, with solids being discharged over a mouth of the rotating basket at its wider end and liquids being collected through perforations defined in the basket, wherein the basket has at least three regions of different inclination relative to the rotational axis of the basket corresponding respectively to (i) a liquid stage at the end of the basket wherein during rotation, solids in a liquids/solids mix are largely suspended as individual particles in a liquid volume, with liquid viscosity and inclination of the liquid stage being principally responsible for controlling the flow rate of the mix along the inclined basket wall, (ii) an intermediate stage wherein during rotation, the solids are immersed in a reduced liquid volume such that contact with each other and with the basket wall is increased, with a resulting apparent increase in liquid viscosity, frictional contact between some of the solids and the basket wall, and local basket inclination being principally responsible for controlling the flow rate of the mixture along the inclined basket wall, and (iii) a solids stage wherein during rotation, surplus liquid having been substantially removed via the basket perforations, solids are largely in contact with each other and the screen, with the coefficient of friction between the solids and the basket wall, between solid particles themselves and local basket inclination being principally responsible for controlling the flow rate of separated solids, the local basket inclination of each stage being set to control the flow rate and residence time over each stage individually and wherein, in addition, there is a reduction in the basket inclination between the solids stage and the mouth of the basket.

2. A centrifuge according to claim 1, wherein the basket wall includes a washing stage located between the liquid stage and the intermediate stage.

3. A centrifuge according to claim 2, wherein the basket inclination at the washing stage is different from that of any of the liquid, intermediate and solids stages.

4. A centrifuge according to claim 2, in which the washing stage has a basket inclination in the range of 5° to 30°.

5. A centrifuge according to claim 1, wherein the different basket stages are joined together with abrupt changes in basket inclination.

6. A centrifuge according to claim 1, wherein the different basket stages are joined together with smooth changes of inclination.

7. A centrifuge according to claim 1, in which the inclination of the different basket stages is of progressively increasing inclination towards the wider, solids discharge end.

8. A centrifuge according to claim 1, in which the basket stages are of progressively decreasing inclination towards the wider, solids discharge end, except for an intermediate washing stage which is of increased inclination compared to that of the immediately preceding intermediate stage.

9. A centrifuge according to claim 1, wherein the liquid intermediate and solids stages have basket inclinations in the ranges of 5°–15°, 10°–25° and 20°–30°, respectively.

10. A centrifuge according to claim 1, including a colour sensing device disposed so as to be focussed on a position in the basket where a colour change is expected between the intermediate and solids stages, and a first control device which responds to detection of a predetermined colour to adjust the flow of liquids/solids mix into the basket or to adjust the speed of basket rotation thereby to adjusting a location of the basket at which a color change occurs in the liquids/solid mixture.

11. A centrifuge according to claim 1, including a viscosity or pressure transducer which is fitted at a position in the basket wall to rotate therewith, and a control device which detects the viscosity or pressure at that position in the basket wall and adjusts the flow of liquids/solids mix to achieve a predetermined viscosity or pressure at that position.

12. A centrifuge according to claim 1, wherein the basket wall includes a washing stage located between the solids stage and the intermediate stage.

13. A centrifuge according to claim 1, including a color sensing device disposed so as to be focused on a position in the basket where a color change is expected between the intermediate and solid stages;

a first control device which responds to detection of a predetermined color to adjust the flow of liquids/solids mix into the basket or to adjust the speed of basket rotation, thereby adjusting a location of the basket at which a color change occurs in the liquids/solid mixture;

a viscosity or pressure transducer which is fitted in the basket wall to rotate therewith; and a second control device which detects the viscosity or pressure sensed by the transducer and adjusts the flow of liquids/solids mix to achieve a predetermined viscosity or pressure.

14. A centrifuge according to claim 1 wherein the reduction in basket inclination adjacent the mouth of the basket over which solids are discharged comprise less than 7% of the basket height and is inclined at an angle between −90° and +10° to the basket rotational axis, to increase the residence time.

15. The centrifuge according to claim 1 wherein the lip between the solids stage and the basket mouth represents less than 7% of the basket height.

16. The centrifuge according to claim 1 wherein the inclination of the lip between the solids stage and the basket mouth is between −90° and +10° % to the axis of rotation to increase residence time.

* * * * *